United States Patent [19]

Hopkins

[11] Patent Number: 5,007,811

[45] Date of Patent: Apr. 16, 1991

[54] ELECTRIC FAN FOR PATIO UMBRELLA

[76] Inventor: Michael H. Hopkins, 315 W. 2nd St., Brenham, Tex. 77833

[21] Appl. No.: 379,085

[22] Filed: Jul. 13, 1989

[51] Int. Cl.[5] ..... A45B 23/00

[52] U.S. Cl. ..... 135/16; 74/421 A; 74/606 R

[58] Field of Search ..... 416/5; 135/16, 20 R; 74/421 A, 606 R

[56] References Cited

U.S. PATENT DOCUMENTS

| | | | |
|---|---|---|---|
| 1,148,332 | 7/1915 | Onyskow | 135/20 R |
| 2,547,896 | 4/1951 | Wellen | 416/5 |
| 2,627,217 | 2/1953 | Hainke et al. | 98/1 |
| 2,729,220 | 1/1956 | Smyrnow | 135/16 |
| 2,817,281 | 12/1957 | Schwan et al. | 98/1 |
| 3,177,881 | 4/1965 | Covington | 135/16 |
| 3,444,799 | 5/1969 | Covington | 98/1 |
| 3,739,792 | 6/1973 | Holland | 135/16 |
| 4,848,385 | 7/1989 | Pennella | 135/16 |

*Primary Examiner*—John C. Fox

*Attorney, Agent, or Firm*—Arnold, White & Durkee

[57] ABSTRACT

An electric fan is provided for mounting on and about a shaft, including the shaft of a patio umbrella. A rotatable drive ring wherein the shaft is positionable perpendicular to and extending through the drive ring is rotated by an electric motor fixedly positionable adjacent the shaft. A gear or belt drive system preferably couples the rotatable motor shaft to the drive ring and a support system, preferably including a plurality of bearings, supports the drive ring and fan assembly. A support brace and collar are provided to attach to the shaft and support the support system. The electric fan provided is mountable to a patio umbrella or other shaft even after construction of the umbrella or other shaft.

22 Claims, 5 Drawing Sheets

ELECTRIC FAN FOR PATIO UMBRELLA

BACKGROUND OF THE INVENTION

I. Field of the Invention

This invention relates to an electric fan capable of being mounted on and about a shaft without severing the shaft. In particular, the invention relates to an electric fan drive to which fan blades may be attached that is capable of being mounted to the shaft of a typical patio umbrella in such a manner that the shaft passes through the central portion of the fan drive yet the umbrella is still easily raised and lowered.

In many areas of the world, large umbrellas are used in conjunction with tables for the purpose of providing shade while dining or drinking outdoors. Heat and/or insects often reduce significantly an individual's capacity to enjoy outdoor leisure activities.

This invention provides a cooling breeze which enhances one's ability to enjoy outdoor dining and drinking over a greater period of the year and provides additional advertising opportunities.

The uniqueness of this invention is that while it looks like an ordinary ceiling fan, it is designed in such a way that it can be fitted to most existing umbrella shafts, without removing the umbrella or cutting the shaft of the umbrella.

It is believed that commercial use of this invention will extend use of outdoor dining facilities at many restaurants and reduce the discomfort associated with hot, still air by adding a cooling breeze to each outdoor table.

Further, space on the housing of the invention may be used for product advertisement and identification.

II. Description of Related Art

Electric fans commonly use an electric motor with fan blades attached to the shaft of the rotor of the motor thus positioning the electric motor central to the fan blades.

Umbrella fans appear to commonly employ this same technique of construction requiring the fan motor to be mounted central to the umbrella shaft. This requires either extensive reworking of an existing umbrella to centrally mount a fan motor or a fan motor and umbrella must be constructed together.

SUMMARY OF THE INVENTION

The device of the present invention for a fan mountable on and about a shaft largely solves the problems associated with mounting a fan to a shaft such as an existing umbrella shaft. The device of the present invention is particularly useful where additional circulation is desired beneath existing umbrellas or adjacent other existing shafts and support poles.

Generally, the device includes an electric fan drive mountable on and about a support shaft. The fan drive comprises a rotatable drive ring wherein the support shaft is positioned substantially perpendicular to and extending through the drive ring, a support system rotatably supports the drive ring, an electric motor is fixedly positioned adjacent the support shaft where the motor has at least one rotatable motor shaft extending from the motor, and a drive system couples the motor shaft to the drive ring and is adapted to transfer rotary motion from the motor shaft to the drive ring. A plurality of fan blades are attachable to the drive ring.

A support collar mountable about the support shaft is able to support the support system. A housing encloses the electric motor and the drive system. Additionally, the housing of the present invention comprises an electric lamp enclosed within the housing.

In a preferred embodiment, the support system includes a support plate mounted substantially parallel to the drive ring. The support collar mountable about the support shaft is able to support the support plate. The support system further includes a plurality of bearings positioned between the support plate and the drive ring, rotatably supporting the drive ring. The drive ring includes a slotted section extending through the drive ring and a slotted drive gear is attached to the drive ring. The slot of the drive gear coincides with the slot of the drive ring. The slotted sections are of sufficient size as to allow the support shaft to be positioned centrally within the drive ring.

The bearings engage and support the drive ring and are selectively positioned about the support plate. The drive system includes at least two drive pinions coupling the motor shaft to the drive ring wherein the pinions are positioned such that at least one of the drive pinions interengages the drive gear throughout rotation of the drive ring. The motor shaft further includes a motor gear and the drive system has a central gear interengaging and coupling the motor gear and the drive pinions.

In another preferred embodiment, the motor shaft includes a motor gear and the drive system has a drive gear attached to the drive ring. The drive system further has a gear assembly to interengage the motor gear and the drive gear.

In a further preferred embodiment, the drive ring includes a slotted section extending through the drive ring where the slotted section is of sufficient size as to allow the support shaft to be positioned centrally within the drive ring. The drive system includes a slotted drive gear attached to the drive ring having a slot sized and positioned to coincide with the drive ring slot. The drive ring further includes a slot key attachable to the drive ring in the slotted section of the drive ring. The slot key includes a drive gear section attached to the slot key such that attaching the slot key to the drive ring defines a closed circular drive gear. The drive system further includes a gear assembly to interengage the motor gear and the drive gear.

In still another preferred embodiment, the drive system includes a motor drive pulley mounted on the motor shaft, a central pulley rotatably mounted to the support system by a central shaft, a drive belt positioned about the motor drive pulley and the central drive pulley for transferring rotary motion from the motor drive pulley to the central drive pulley, a central gear mounted on the central shaft, a drive gear attached to the drive ring, and a drive pinion rotatably mounted to the support system to transfer rotary motion of the central gear to the drive gear.

In yet another preferred embodiment, the drive system includes a drive gear attached to the drive ring. The drive gear has a first and a second portion. The drive ring has a first and a second portion pivotally attached to one another. The drive ring and the attached drive gear being adapted to receive the shaft.

In an additional preferred embodiment, the drive ring has a slot extending through the drive ring and the slot is of sufficient size as to allow the support shaft to be positioned centrally within the drive ring. The support system rotatably supports the drive ring and the support system includes bearings positioned between the support system and the drive ring wherein the bearings rotatably support the drive ring. An electric motor housing, including an electric motor and a gear box and having at least two rotatable motor shafts extending from the motor housing is fixedly positioned adjacent the support shaft. A drive gear having a slot is attached to the drive ring wherein the drive gear slot is sized and positioned to coincide with the drive ring slot. The motor shafts each include a motor gear and the motor shafts are positioned such that at least one of the motor gears interengages the drive gear throughout the rotation of the drive ring.

In all described embodiments of the present invention, a plurality of fan blades are attachable to the rotatable drive ring. This allows a circular fan to be positioned on and about a shaft which allows a circular fan to be mounted to the shaft of a typical patio umbrella after construction of the umbrella.

DETAILED DESCRIPTION OF THE PREFERRED EMBODIMENTS

Figure 1:
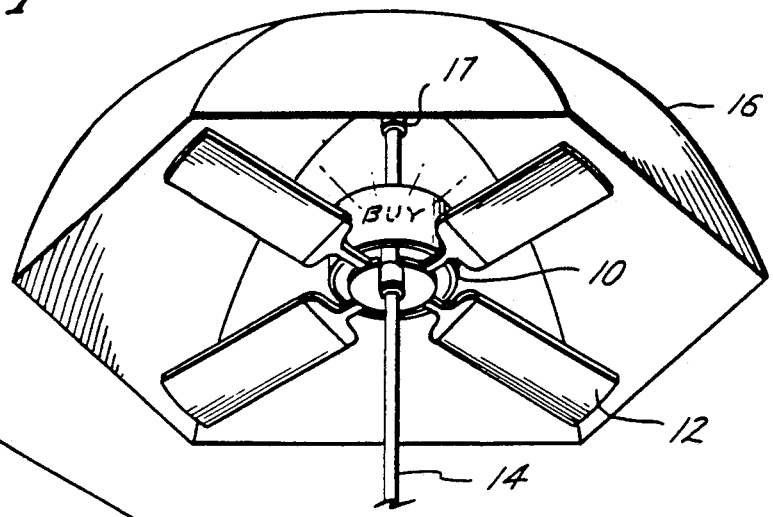
FIG. 1 is a perspective view of a patio umbrella fitted with the device of the present invention.

FIG. 1 illustrates a typical application of the present invention. Fan assembly 10 with blades 12 attached is mounted on and about shaft 14. Shaft 14 also serves as the shaft for umbrella 16 and fan assembly 10 is positioned below umbrella 16 on and about shaft 14. Umbrella slide 17 traverses a portion of shaft 14 allowing a user to fold umbrella 16. Because the drive motor of the present invention is not positioned central to the fan assembly 10, the present invention may be centrally attached to an existing shaft without the need to sever or disassemble the shaft. It should be understood that even though the following description relates to use of the present invention with an umbrella, the present invention may also be used on other similar support shafts or poles not part of an umbrella.

Figure 2:
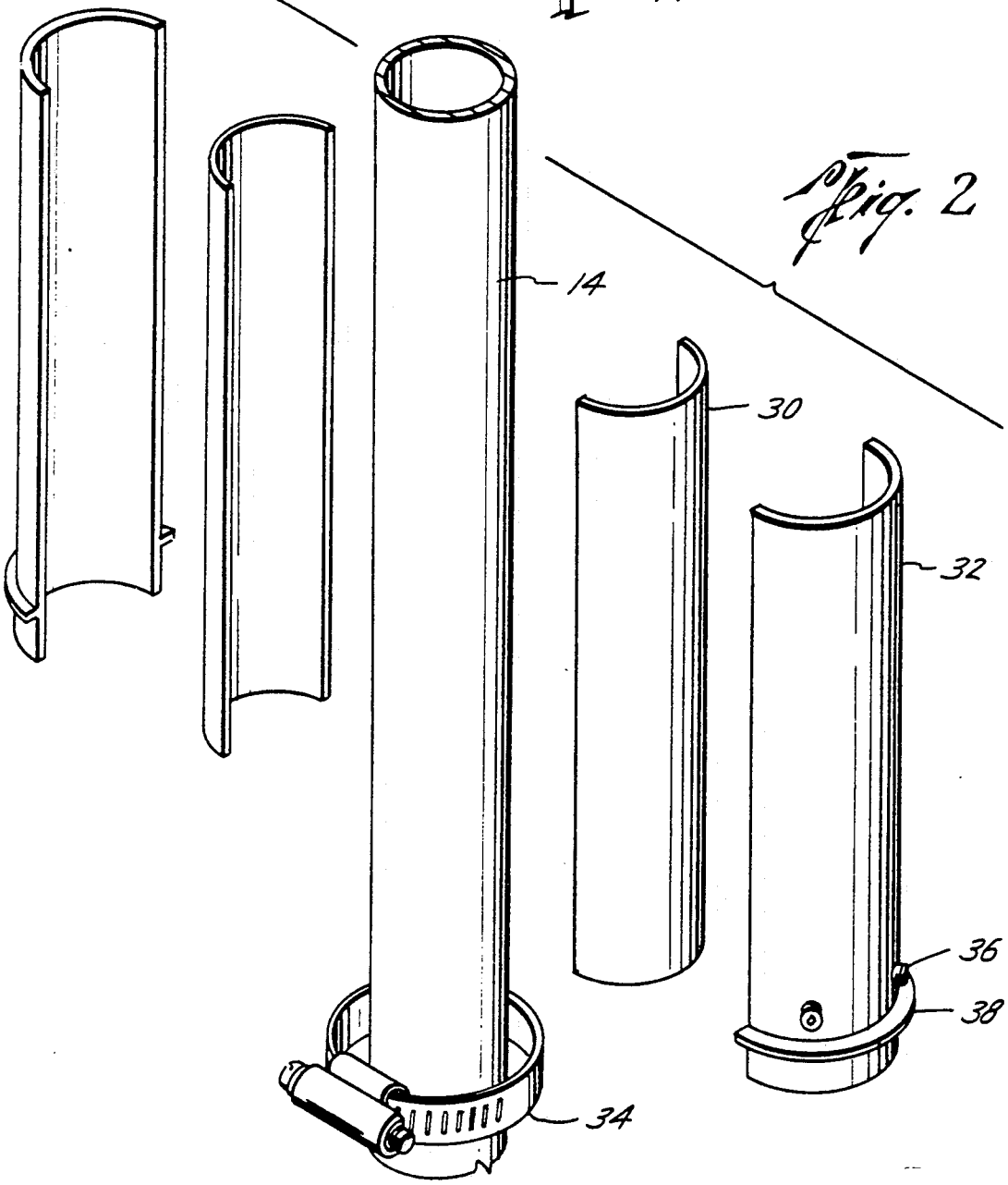
FIG. 2 is an exploded view of a support collar in accordance with the present invention.

FIG. 2 illustrates a preferred embodiment of a support collar of the present invention. Support collar 38 is a rigid lip formed from and extending outwardly from support brace 32. Support brace 32 comprises two arcuate portions which may be positioned about shaft 14 in order to mount fan assembly 10 on and about shaft 14. To account for varying sizes of shaft 14, shim 30 may be used between shaft 14 and support brace 32 to allow support brace 32 to be secured about shaft 14 when clamp 34 is attached about support brace 32 below collar 38. Locking screws 36 may also serve to secure support brace 32 to shaft 14. When attached to shaft 14, support brace 32 serves to provide a secure support surface for assembly 10 and define a uniform diameter support brace and support collar even though the diameter of shaft 14 may vary. Thus through the use of various thicknesses of shim 30, support collar 38 may be securely affixed to a variety of diameter shafts. While clamp 34 is shown, it should be understood that various other means are available for securing brace 32 to shaft 14 such as latches, bolts, etc.

Figure 6:
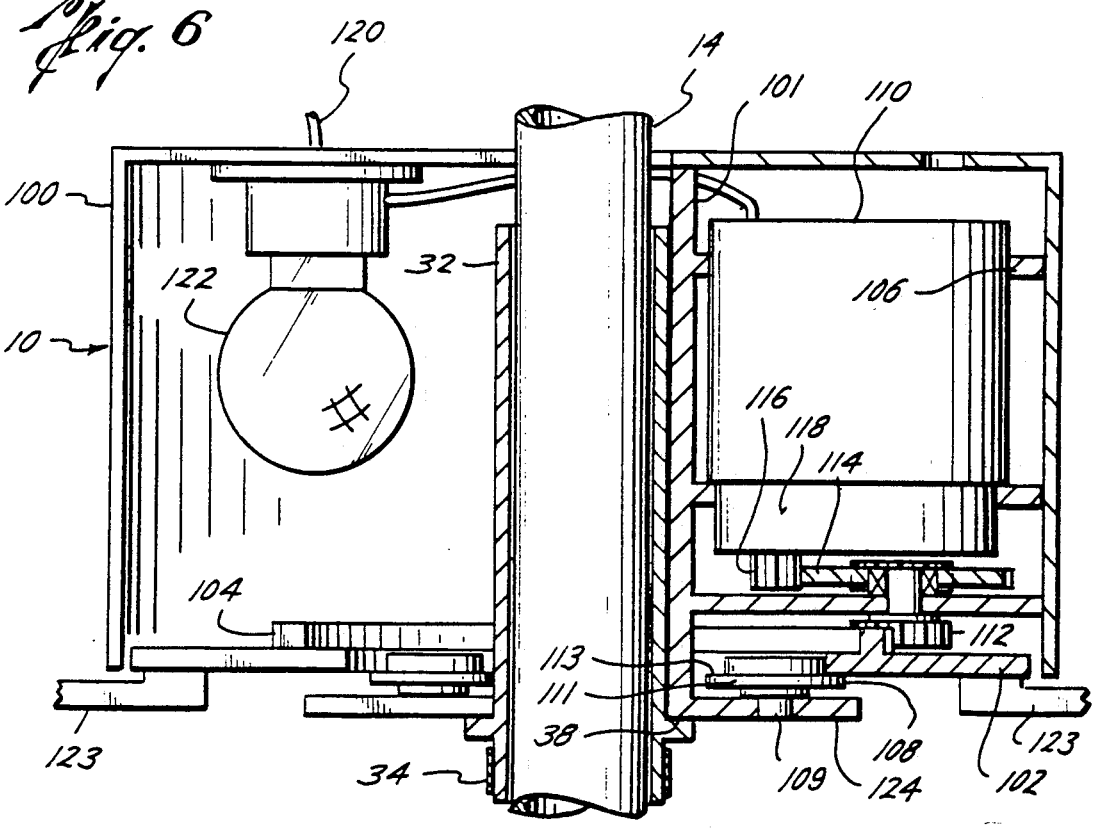
FIG. 6 is a sectional view of the device of FIG. 5.

As can be understood from FIGS. 1 and 6, support brace 32 with support collar 38 may be combined with umbrella slide 17 enabling a user to easily fold umbrella 16 with fan assembly 10 mounted on and about shaft 14.

Figure 3:
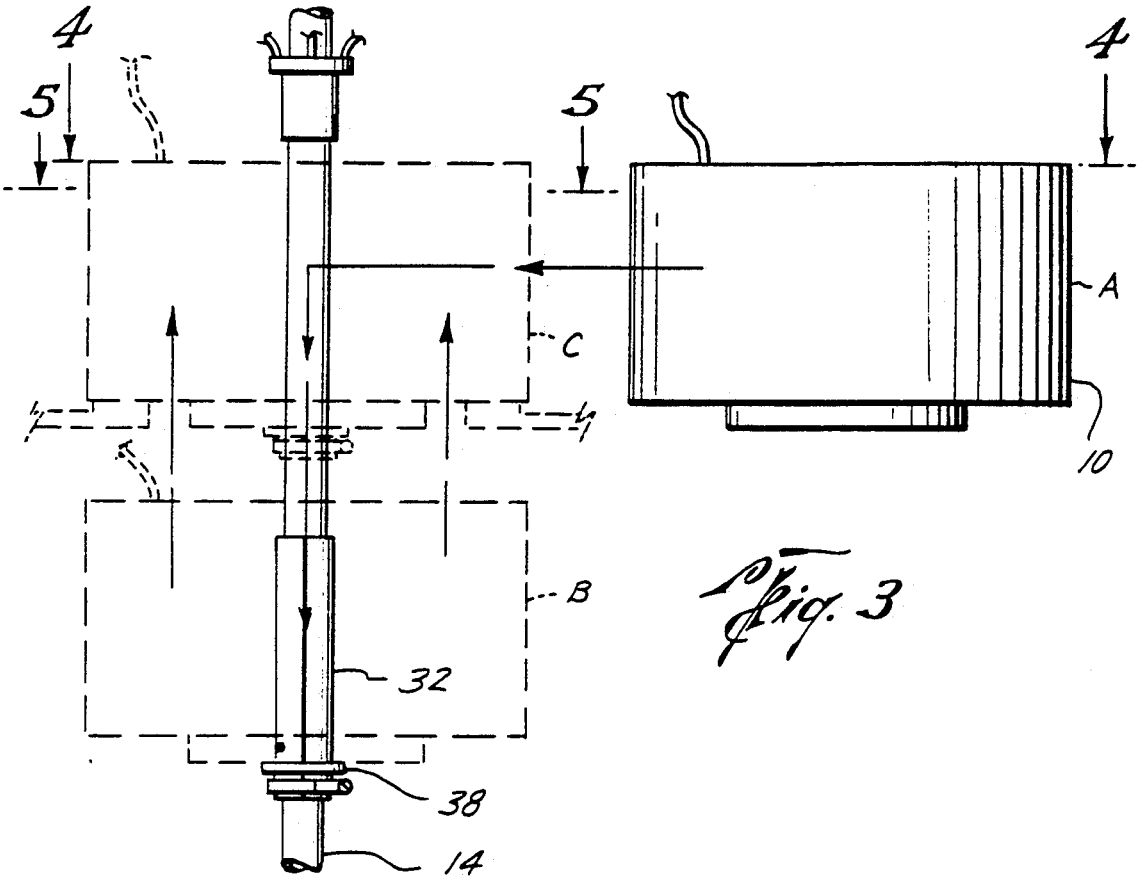
FIGS. 3 and 4 are elevational views of an installation of the present invention on and about a shaft.
Figure 4:
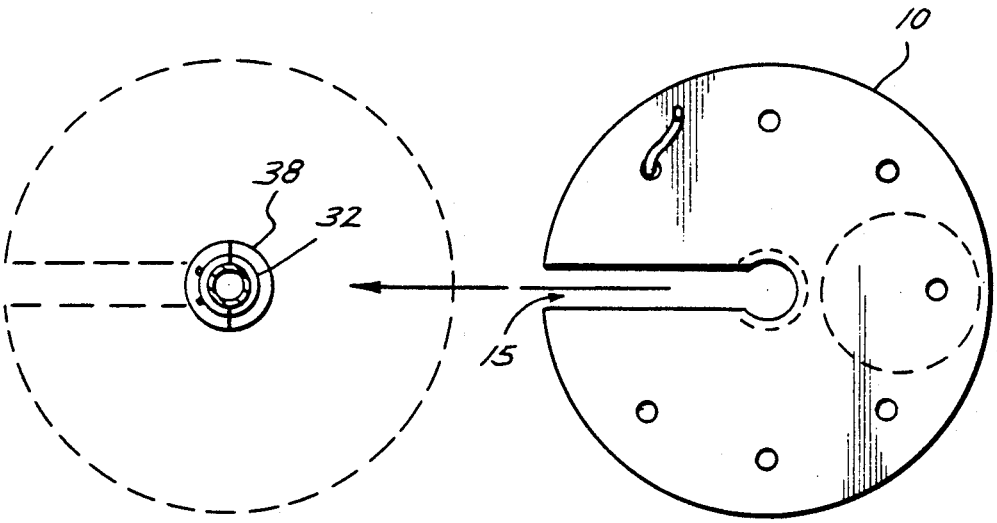

Turning now to FIGS. 3 and 4, after installation of brace 32, fan assembly 10 may be placed on and about shaft 14 by passing shaft 14 through slot 15 of assembly 10 into the center of assembly 10. As shown, support brace 32 and support collar 38 are affixed to shaft 14 and fan assembly 10 may be lowered onto support collar 38 thus supporting fan assembly 10 on and about shaft 14. Support brace 32 and support collar 38 may be raised or lowered on shaft 14 and secured in position as desired by the user. FIG. 3, in positions A and B, illustrates fan assembly 10 being placed on and about shaft 14, support brace 32 and support collar 38. Position C shows support brace 32 and support collar 38 raised to an elevated position desired by a user.

Figure 5:
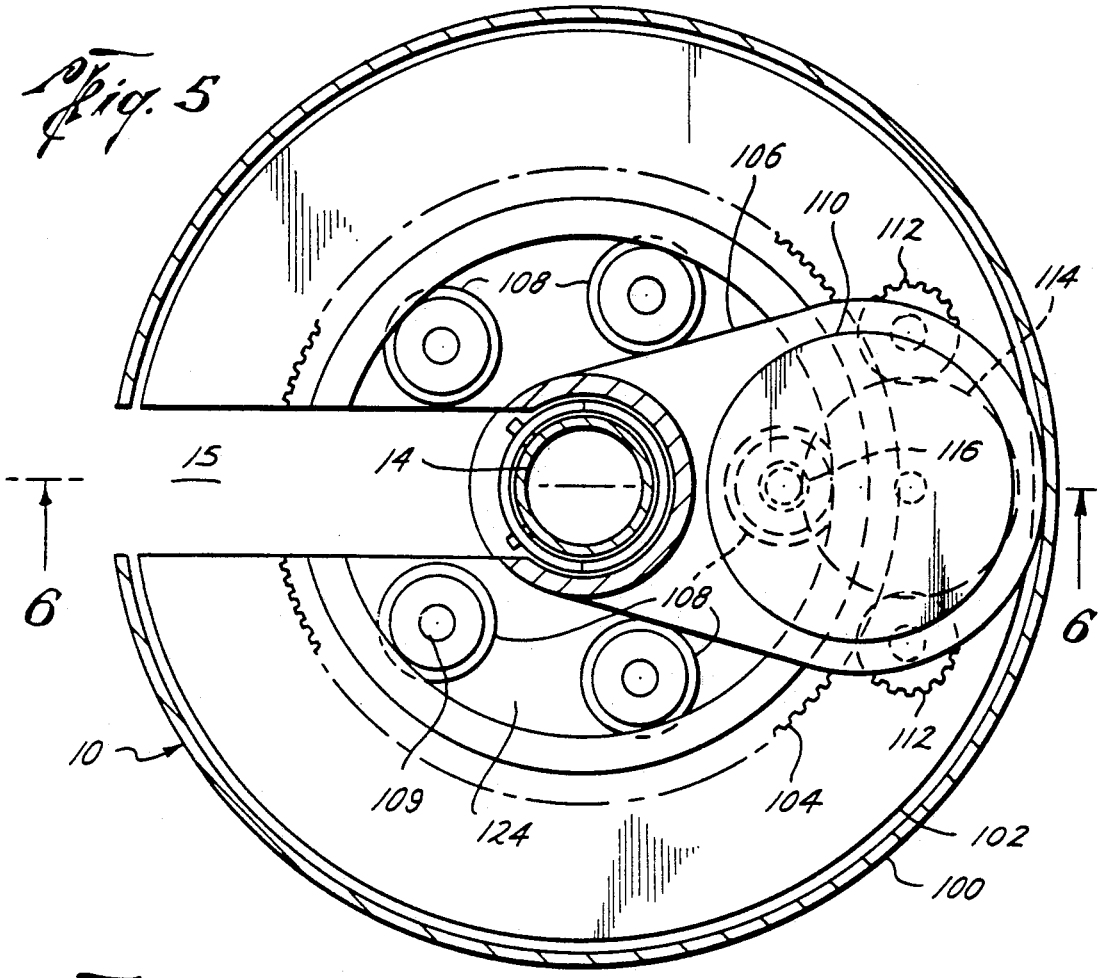
FIG. 5 is a partial horizontal section of a first preferred embodiment of a device in accordance with the present invention.

FIGS. 5 and 6 illustrate cross sectional views of a preferred embodiment of the present invention. FIG. 5 shows fan assembly 10 positioned on shaft 14 and support collar 38 supporting bearing support plate 124. In this embodiment, rotatable circular bearings 108 are mounted on support posts 109 connected to bearing support plate 124. Bearings 108 include support shoulder 111 having surface 113. Bearings 108 couple to and support rotatable drive ring 102 which partially rests on surface 113. Drive gear 104 is fixedly attached to the upper surface of drive ring 102 such that drive gear 104 is engaged by drive pinion 112 and rotation of drive pinions 112 causes drive gear 104 and drive ring 102 to rotate about shaft 14. This rotary movement of ring 102 is possible since it is rotatably supported and held in position about its inner circumference by shoulders 111 of bearings 108.

Drive motor 110 is fixedly positioned adjacent to shaft 14 by motor support 106. MOtor support 106 is preferably secured to slotted tube 101 which extends vertically from support plate 124. The slot of tube 101 is sized and positioned to coincide with slot 15. Slotted tube 101 is positionable about support brace 32. Motor drive gear 116 is affixed to the rotatable motor shaft extending from motor 110 and motor drive gear 116 interengages central gear 114. Central gear 114 in turn interengages drive pinions 112 resulting in the rotation of drive ring 102 when drive motor 110 is powered to rotate gear 116 on the motor shaft.

In this preferred embodiment, five bearings 108 are spaced substantially equidistantly about the interior circumference of drive ring 102 and rotatably attached to support plate 124. Drive pinions 112 are spaced such that during rotation of drive ring 102 when slot 15 in ring 102 and gear 104 rotates into position to align with the first pinion 112 thereby preventing the interengagement of this drive pinion 112 with drive gear 104, the other drive pinion 112 will remain interengaged with drive gear 104 allowing the uninterrupted rotation of drive ring 102. As the rotation continues, slot 15 then aligns with the second pinion 112. At this point in the rotation, first pinion 112 has reengaged drive gear 104 thereby providing for the continued uninterrupted rotation of drive ring 102. Further, the five bearings 108 assure that drive ring 102 remains centrally aligned to shaft 14.

FIG. 5 further illustrates the positioning of slot 15 of drive ring 102 with a vacant area in bearing support plate 124. With slot 15 positioned to coincide with the vacant area of bearing support plate 124, assembly 10 is easily installed on support shaft 14 as shown in FIG. 3.

FIG. 6 is a cross sectional view of the embodiment shown in FIG. 5 and shows shaft 14 central to bearing support plate 124 and drive ring 102. As previously discussed, bearings 108 couple to and support drive ring 102 allowing the interengagement of drive gear 104 with drive pinions 112, central gear 114 and motor drive gear 116 to rotate drive gear 102 about shaft 14.

FIG. 6 further illustrates gearbox 118 abutting drive motor 110. Gearbox 118 allows for a gearing or speed reduction from drive motor 110.

Housing 100 encloses drive motor 110, motor drive gear 116, central gear 114 and drive pinions 112 allowing the lower outer surface of drive ring 102, as seen in FIG. 6, to be accessible from outside housing 100. Fan blades 123 are then attachable to drive ring 102.

In all preferred embodiments, electric light 122 may also be enclosed in housing 100. In addition to providing general lighting, where housing 100 comprises a transparent or translucent type material, messages may be placed on and about housing 100 which may then be illuminated by light 122. FIG. 1 illustrates a message preferably illuminated by light 122.

Figure 7:
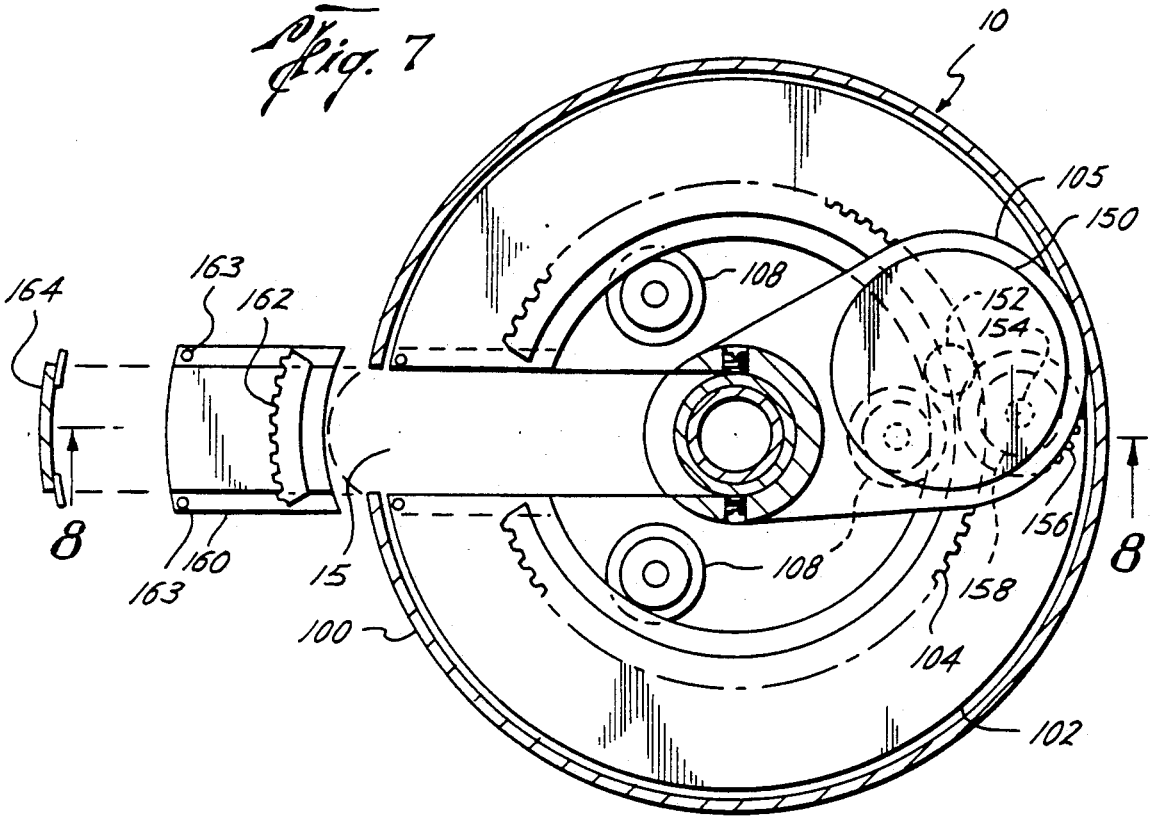
FIG. 7 is a horizontal section of a second preferred embodiment of a device in accordance with the present invention.
Figure 8:
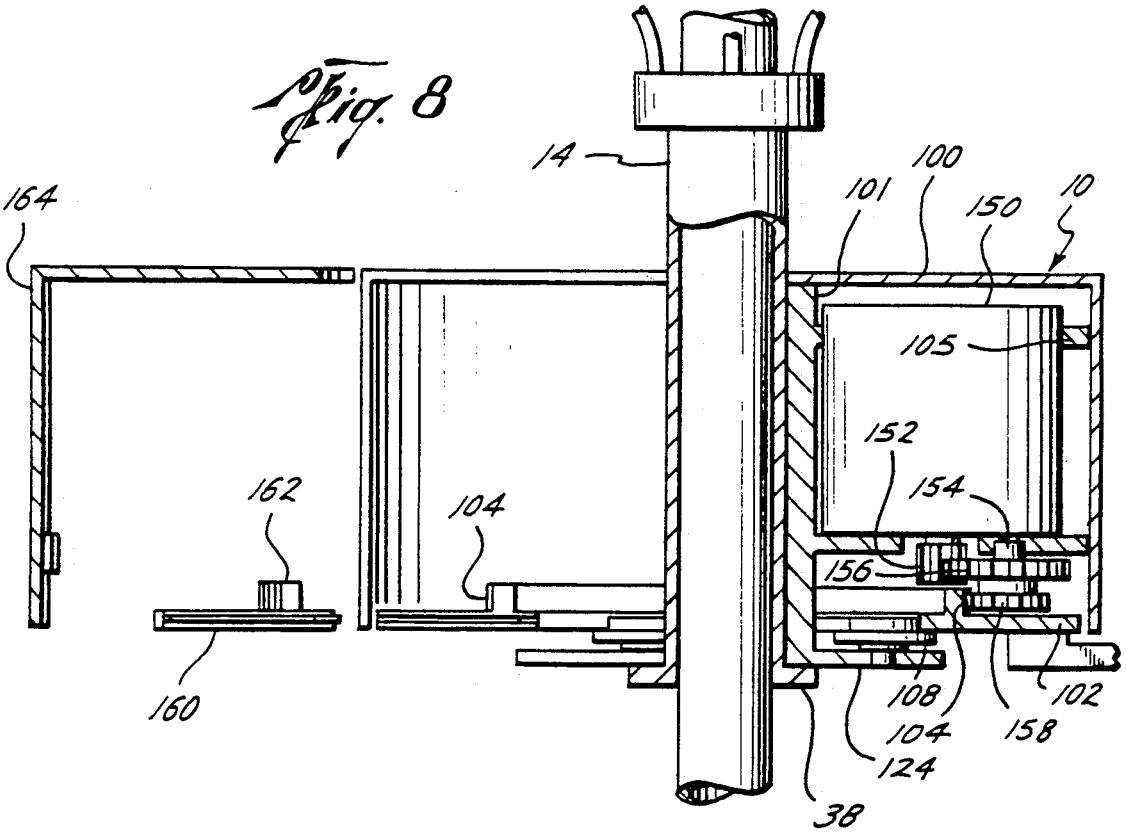
FIG. 8 is a sectional view of the device of FIG. 7.

FIGS. 7 and 8 show another embodiment of the present invention. Fan assembly 10 includes bearing support plate 124 which is supported on and about shaft 14 by support collar 38. After fan assembly 10 is positioned on and about shaft 14, drive ring key 160 having drive gear key 162 attached thereto serves as a slot key and may be inserted in slot 15 and secured to drive ring 102 with fasteners such as screws 163. Insertion of key 160 thereby eliminates slot portion 15 of drive ring 102 allowing a complete gear surface for drive gear 104.

Drive motor 150 is fixedly positioned adjacent shaft 14 by motor support 105 which is preferably secured to slotted tube 101 which extends vertically from support plate 124. Motor drive gear 152 interengages first reduction gear 156 which is attached to rotatable reduction gear shaft 154. Second reduction gear 158 is also attached to reduction gear shaft 154 and second reduction gear 158 interengages drive gear 104 resulting in the rotation of drive ring 102 when drive motor 150 is powered to rotate gear 152 on the motor shaft. Bearings 108 again couple and support rotatable drive ring 102 in relation to bearing support plate 124.

The use of drive ring key 160 and drive gear 162 is preferred where a single drive pinion, such as second reduction gear 158, is used to engage drive ring 102 in place of the dual pinions 112 in the previous embodiment. Drive gear key 162 avoids the problem of slot 15 aligning with second reduction gear 158 causing disengagement of gear 104 from gear 158 thereby ceasing rotation of drive ring 102. Additionally, a fewer number of bearings 108 may be utilized in the embodiment shown in FIGS. 7 and 8. The use of drive gear key 162 and drive ring key 160 may allow the use of three bearings 108 to retain shaft 14 central to drive ring 102.

Where assembly 10 may be placed over an end of shaft 14 during installation, key 160 may be permanently affixed to drive ring 102 or slot 15 may be eliminated.

Additionally, housing key 164 is positionable in housing 100 allowing housing 100 to more fully enclose and protect drive motor 150, motor drive gear 152, first reduction gear 156, second reduction gear 158 and reduction gear shaft 154. Housing key 164 may also be used with any embodiment of the present invention.

Figure 9:
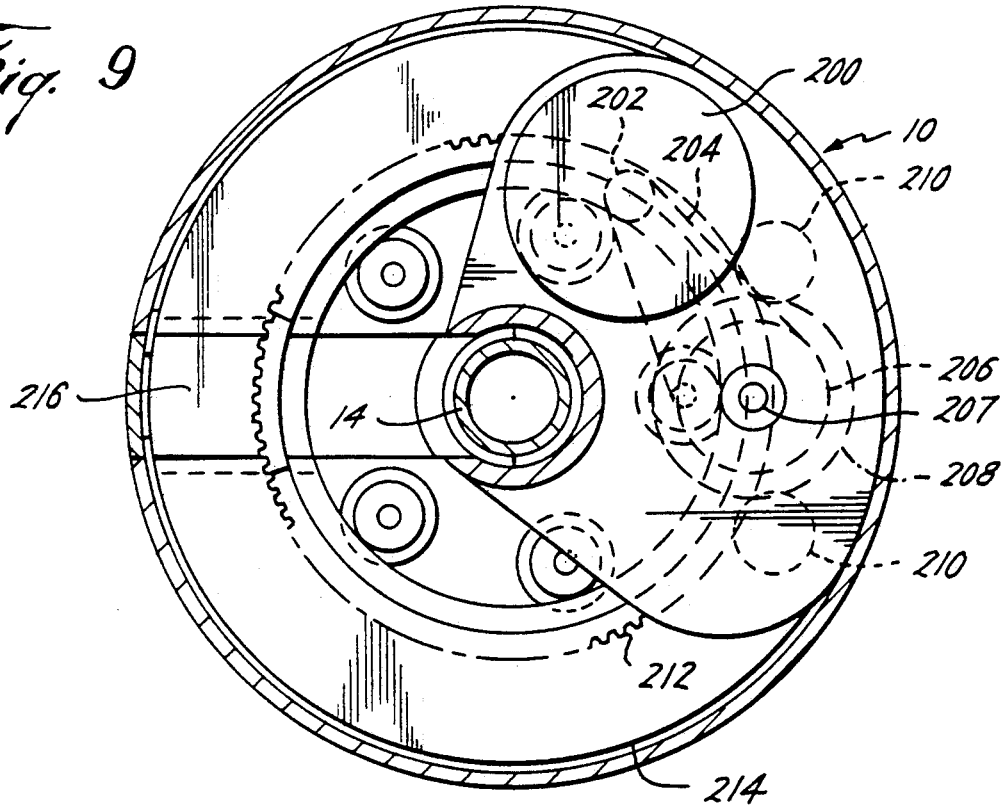
FIG. 9 is a horizontal section of a third preferred embodiment of a device in accordance with the present invention.

FIG. 9 illustrates still another embodiment of the present invention wherein drive ring 214, which includes a shoulder extending upwardly having external drive gear 212 is interengagable by drive pinion 210. In this embodiment, motor 200 has motor drive pulley 202 attached to the rotatable shaft extending from motor 200. Central pulley 206 is attached to rotatable central shaft 207. Central gear 208 is also attached to central shaft 207. Drive belt 204 extends about and between motor drive pulley 202 and central pulley 206. Central gear 208 interengages drive pinions 210 and the rotation of drive pinions 210 engaging with drive gear 212 causes drive ring 214 to rotate about shaft 14 when motor 200 is powered to rotate drive pulley 202 o the motor shaft.

FIG. 9 also shows optional key 216 in place in drive ring 214. Key 216 is not required to assure a continuous rotation of drive ring 214 when two pinions 210 engage drive gear 212 and where drive pinions 210 are spaced such that at least one drive pinion 210 continually engages drive gear 212 regardless of the use or non-use of key 216.

One skilled in the art will recognize that drive belt 204 of this embodiment may be extended and drive gear 214 may be replaced by a pulley allowing a single belt positioned about and between the pulley replacement of drive gear 214 and drive pulley 202 to rotate drive ring 214.

Figure 10:
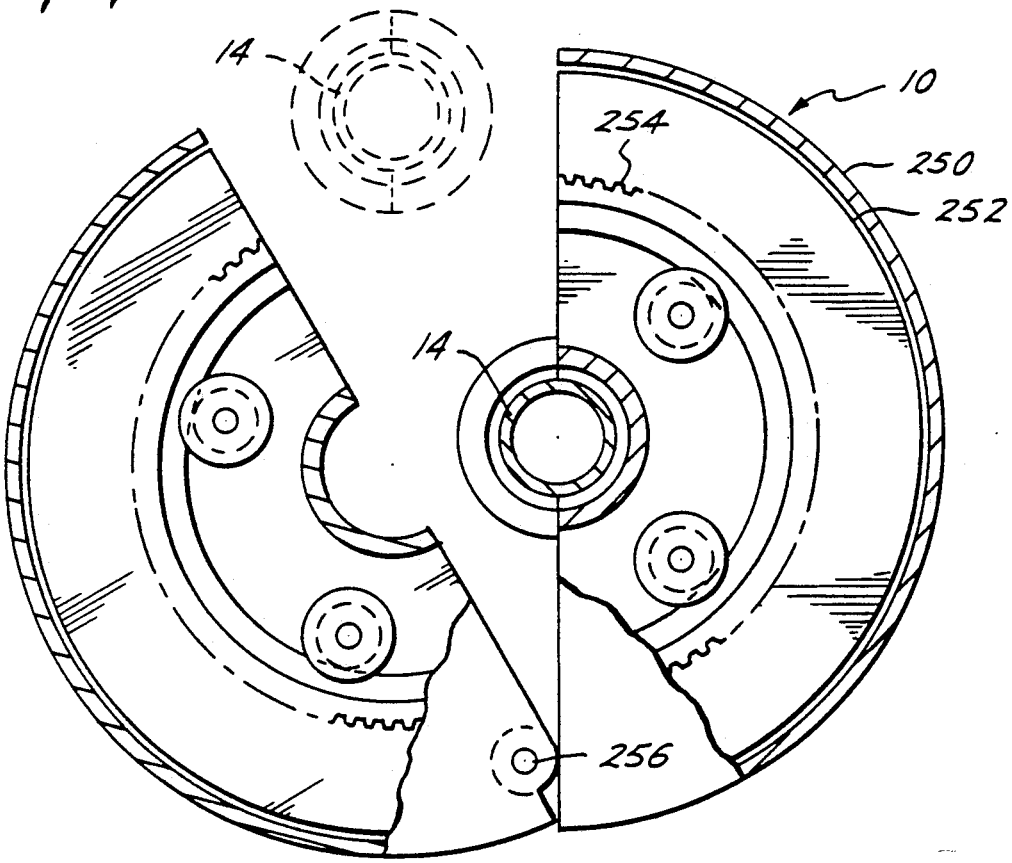
FIG. 10 is a fragmentary horizontal section of a fourth preferred embodiment of a device in accordance with the present invention.

FIG. 10 shows a further embodiment of fan assembly 10. In this embodiment, shaft 14 is positionable central to drive ring 252 and drive gear 254. Housing 250, drive ring 252 and drive gear 254 may pivot about hinge pivot 256 allowing fan assembly 10 to be opened and closed about shaft 14. When fan assembly 10 is opened, shaft 14 may be positioned central to drive ring 252, and drive ring 252, drive gear 254 and housing 250 may be pivoted closed. Fasteners are preferably inserted in drive ring 252 opposite pivot 256 to restrict the undesired opening of drive ring 252. Similarly, housing 250 may be additionally secured by fasteners from undesired opening. Drive gear 254, being attached to drive ring 252, may utilize but does not require additional fasteners to restrict undesired opening of gear 254. Shaft 14 may thus be secured central to drive ring 252.

In a still further embodiment, gearbox 118 shown in FIG. 6 may be extended. In particular, motor drive gear 116 and central gear 114 may be contained within gearbox 118 or a functionally similar combination may be enclosed in gearbox 118. In this embodiment where drive motor 110 and gearbox 118 define a motor housing, the only drive mechanisms that need extend from the motor housing may be two drive pinions 112 which may interengage drive gear 104.

A variety of materials may be used in the manufacture of the present invention. Gear materials preferably must exhibit sufficient strength and wear resistance to allow for the regular operation of the invention over a substantial length of time. For purposes of example only, nylon and plastic gears and bearings are considered preferable in the present embodiments due to their wear resistance, low cost and low noise characteristics. Fan blades are preferably constructed of a lightweight, low cost material. For purposes of example only, styrofoam coated to provide a substantially smooth surface may be considered a preferable fan blade material.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size and arrangement of parts. For example, equivalent elements may be substituted for those illustrated and described herein, parts may be reversed, and certain features of the invention may be utilized independently of the use of other features, all as would be apparent to one skilled in the art after having the benefit of this description of the invention.

What is claimed is:

1. An electric fan drive mountable on and about a unitary support shaft comprising:

a rotatable drive ring wherein said support shaft is positioned substantially perpendicular to and extending through said drive ring;

support means positioned on the outer surface of said unitary support shaft for rotatably supporting said drive ring;

an electric motor fixedly positioned adjacent said support shaft, said motor having at least one rotatable motor shaft extending from said motor; and drive means coupling said motor shaft to said drive ring and adapted to transfer rotary motion from said motor shaft to said drive ring.

2. The electric fan drive of claim 1 wherein said support means includes a support plate mounted substantially parallel to said driven ring.

3. The electric fan drive of claim 2 wherein said support means further includes a support collar mountable about said support shaft and able to support said support plate.

4. The electric fan drive of claim 2 wherein said support means further includes a plurality of bearings positioned between said support plate and said drive ring wherein said bearings rotatably support said drive ring.

5. The electric fan drive of claim 4 wherein said drive ring includes a slotted section extending through said drive ring, said slotted section being of sufficient size as to allow said support shaft to be positioned centrally within said drive ring.

6. The electric fan drive of claim 5 wherein said drive means includes a slotted drive gear attached to said drive ring, having a slot sized and positioned to coincide with said drive ring slot.

7. The electric fan drive of claim 6 wherein:

said bearings engage and support said drive ring and are selectively positioned about said support plate; and said drive means includes at least two drive pinions coupling said motor shaft to said drive ring and wherein said pinions are positioned such that at least one of said drive pinions interengages said drive gear throughout rotation of said drive ring.

8. The electric fan drive of claim 7 wherein said motor shaft includes a motor gear and said drive means further comprises a central gear interengaging and coupling said motor gear and said drive pinions.

9. The electric fan drive of claim 1 further comprising a housing enclosing said electric motor and said drive means.

10. The electric fan drive of claim 9 wherein said housing comprises an electric lamp enclosed in said housing.

11. The electric fan drive of claim 1 wherein said motor shaft includes a motor gear and said drive means includes a drive gear attached to said drive ring.

12. The electric fan drive of claim 11 wherein said drive means further includes a gear assembly to interengage said motor gear and said drive gear.

13. The electric fan drive of claim 11 wherein:

said drive ring includes a slotted section extending through said drive ring, said slotted section being of sufficient size as to allow said support shaft to be positioned centrally within said drive ring;

said drive means includes a slotted drive gear attached to said drive ring, having a slot sized and positioned to coincide with said drive ring slot;

said drive ring further includes a slot key attachable to said drive ring in said slotted section; and said slot key includes a drive gear section such that attaching said slot key to said drive ring defines a closed circular drive gear.

14. The electric fan drive of claim 13 wherein said drive means further includes a gear assembly to interengage said motor gear and said drive gear.

15. The electric fan drive of claim 1 wherein said drive means includes:

a motor drive pulley mounted on said motor shaft;

a central drive pulley rotatably mounted to said support means by a central shaft;

a drive belt positioned about said motor drive pulley and said central drive pulley for transferring rotary motion from said motor drive pulley to said central drive pulley;

a central gear mounted on said central shaft;

a drive gear attached to said drive ring; and a drive pinion rotatably mounted to said support means to transfer rotary motion of said central gear to said drive gear.

16. The electric fan drive of claim 1 wherein:

said drive means includes a drive gear attached to said drive ring, said drive gear having a first and a second portion; and said drive ring further includes a first and a second portion pivotally attached to one another, said drive ring and said attached drive gear being adapted to receive said shaft.

17. The electric fan drive of claim 1 further comprising a plurality of fan blades attachable to said drive ring.

18. An electric fan drive mountable on and about a support shaft comprising:

a rotatable drive ring having a slot extending through said drive ring wherein said shaft is positioned substantially perpendicular to and extending through said drive ring and said slot being of sufficient size a to allow said support shaft to be positioned centrally within said drive ring;

support means for rotatably supporting said drive ring, said support means including bearings positioned between said support means and said drive ring wherein said bearings rotatably support said drive ring;

an electric motor housing including an electric motor and a gearbox and having at least two rotatable motor shafts extending from said motor housing being fixedly positioned adjacent said support shaft;

a drive gear having a slot and being attached to said drive ring wherein said drive gear slot being sized and positioned to coincide with said drive ring slot;

said motor shafts each including a motor gear; and said motor shafts being positioned such that at least one of said motor gears interengages said drive gear throughout rotation of said drive ring.

19. The electric fan drive of claim 18 further including a support collar mountable about said support shaft and able to support said support means.

20. The electric fan drive of claim 18 further including a plurality of fan blades attachable to said drive ring.

21. An electric fan drive mountable around a support shaft comprising:

a rotatable drive ring positioned around and substantially perpendicular to said support shaft, said drive ring having a slot extending through said drive ring, said slot being of sufficient size as to allow said support shaft to be positioned centrally within said drive ring;

support means for rotatably supporting said drive ring;

an electric motor assembly fixedly positioned adjacent said support shaft for generating rotary motion;

a drive gear attached to said drive ring and including a slot being sized and positioned to coincide with said drive ring slot; and a gear assembly connected to said motor assembly and adapted to interengage with said drive gear throughout rotation of said drive ring for communicating rotary motion from said motor assembly to said drive ring.

22. An electric fan drive mountable on and about a unitary support shaft comprising:

a rotatable drive ring having a slot extending through said drive ring wherein said support shaft is positioned substantially perpendicular to and extending through said drive ring and said slot being of sufficient size to allow said shaft to be positioned centrally within said drive ring;

support means for rotatably supporting said drive ring;

an electric motor fixedly positioned adjacent said support shaft, said motor having at least one rotatable motor shaft extending from said motor; and drive means coupling said motor shaft to said drive ring and adapted to transfer rotary motion from said motor shaft to said drive ring.

* * * * *